US006534596B2

(12) United States Patent
Harris et al.

(10) Patent No.: US 6,534,596 B2
(45) **Date of Patent: *Mar. 18, 2003**

(54) GOLF BALLS FORMED OF COMPOSITIONS COMPRISING POLY (TRIMETHYLENE TEREPHTHALATE) AND METHOD OF MAKING SUCH BALLS

(75) Inventors: Kevin Harris, New Bedford, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/851,894

(22) Filed: May 9, 2001

(65) Prior Publication Data

US 2001/0020067 A1 Sep. 6, 2001

Related U.S. Application Data

(63) Continuation of application No. 09/063,116, filed on Apr. 20, 1998, now Pat. No. 6,232,400.

(51) Int. Cl.[7] ..... A63B 37/12; C08L 67/02

(52) U.S. Cl. ..... 525/176; 525/177; 528/308.6; 473/372; 473/373; 473/374

(58) Field of Search ..... 525/176, 177; 528/308.6; 473/372, 373, 374

(56) References Cited

U.S. PATENT DOCUMENTS

| | | | | |
|---|---|---|---|---|
| 2,465,319 | A | | 3/1949 | Whinfield et al. |
| 3,262,272 | A | | 7/1966 | Barakauskas et al. |
| 4,274,637 | A | | 6/1981 | Molitor |
| 4,679,795 | A | | 7/1987 | Melvin et al. |
| 4,781,383 | A | | 11/1988 | Kamada et al. |
| 4,858,924 | A | | 8/1989 | Saito et al. |
| 5,002,281 | A | | 3/1991 | Nakahara et al. |
| 5,688,191 | A | | 11/1997 | Cavallaro et al. |
| 5,691,066 | A | | 11/1997 | Rajagopalan |
| 5,948,864 | A | * | 9/1999 | Rajagopalan |
| 5,962,140 | A | * | 10/1999 | Rajagopalan |
| 5,981,654 | A | | 11/1999 | Rajagopalan |
| 6,001,930 | A | | 12/1999 | Rajagopalan |
| 6,232,400 | B1 | * | 5/2001 | Harris |

FOREIGN PATENT DOCUMENTS

| | | |
|---|---|---|
| EP | 0 633 043 | 7/1994 |

OTHER PUBLICATIONS

Dr. H.S. Brown et al., "Texturing of Textile Filament Yarns Based On Polytrimethylene Terephthalate", Chem Fibers, Int. 1997, 47 (1), 72–74.

"PTT: Trying Out The New Contender", European Plastics News, Jun. 1997, 35–36.

Dangayach et al., "Poly (Trimethylene Terephthalate) New Opportunity In Engineering Thermoplastic Applications", ANTEC '97, 2097–2101.

Piccolini et al., "Brief Analyses Of Commercially Interesting U.S. Patents", CHEMTECH, Oct. 1997.

Schauhoff et al., "New Developments In The Production Of Polytrimethylene Terephthalate (PTT)", Chem Fibers Int., 1996, 46(4), 263–264.

Traub et al., "Mechanical Properties Of Fibers Made Of Polytrimethylene Terephthalate", Chem Fibers Int., 1995, 45 (2) 110–111.

Traub et al., "Synthesis And Properties Of Fiber–Grade Poly(trimethylene Terephthalate)", Die Angewandte Makromolekulare Chemie 230 (1995) 179–187 (Nr. 4055).

Ward et al., "The Mechanical Properties And Structure of Poly(m–methylene terephtalate) Fibers", Journal of Polymer Science: Polymer Physics Edition, vol. 14, 263–274 (1976).

* cited by examiner

*Primary Examiner*—David J. Buttner
(74) *Attorney, Agent, or Firm*—Swidler Berlin Shereff Friedman, LLP

(57) ABSTRACT

This invention provides a golf ball constituting or having a core layer, intermediate layer and/or cover layer consisting in whole or in part of a poly(trimethylene terephthalate) composition. The invention also provides methods for making such a ball. The compositions of the core layer, intermediate layer and/or cover layer may be foamed or unfoamed. The poly(trimethylene terephthalate) may comprise from about 1 to about 100 percent by weight of the core layer, intermediate layer and/or cover layer. In addition, the poly(trimethylene terephthalate) material may be blended with conventional materials employed to form golf ball cores, intermediate layers and/or covers.

20 Claims, No Drawings

GOLF BALLS FORMED OF COMPOSITIONS COMPRISING POLY (TRIMETHYLENE TEREPHTHALATE) AND METHOD OF MAKING SUCH BALLS

This is a continuation of application No. 09/063,116, filed Apr. 20, 1998 now U.S. Pat. No. 6,232,400.

FIELD OF THE INVENTION

The invention relates to golf balls and, more particularly, to golf balls having one or more core layer(s), cover layer(s) and/or intermediate layer(s), wherein at least one of the layers is formed of a poly(trimethylene terephthalate) ("PTT") composition and wherein the PTT composition is either 100 weight percent PTT or a PTT blend with other polymers. The invention also relates to methods for making such golf balls from PTT compositions. Golf balls produced in accordance with the present invention are characterized by improved properties including abrasion resistance, cut resistance and durability.

BACKGROUND OF THE INVENTION

Three-piece, wound golf balls with balata covers are preferred by most expert golfers. These balls provide a combination of distance, high spin rate, and control that is not available with other types of golf balls. However, balata is easily damaged in normal play, and, thus, lacks the durability required by the average golfer.

In contrast, amateur golfers typically prefer a solid, two-piece ball with an ionomer cover, which provides a combination of distance and durability. Because of the hardness of the ionomer cover, these balls are almost impossible to cut, but they also have a very hard "feel", which many golfers find unacceptable, and a lower spin rate, making these balls more difficult to draw or fade. The differences in the spin rate can be attributed to the differences in the composition and construction of both the cover and the core.

Many attempts have been made to produce a golf ball with the control and feel of a wound balata ball and the durability of a solid, two-piece ball, but none have succeeded totally. For example, U.S. Pat. No. 4,274,637 to Molitor discloses two- and three-piece golf balls having covers completely or partially formed from a cellular polymeric material to improve backspin, but does not provide any examples that compare the spin rates of the disclosed golf balls with those of prior art balls.

U.S. Pat. No. 5,002,281 to Nakahara et al. discloses a three-piece solid golf ball having an ionomer cover and a solid core consisting of a soft inner core surrounded by a hard outer shell, where the difference in the hardness of the two parts of the core is at least 10 on the JIS-C scale.

Similarly, U.S. Pat. No. 4,781,383 to Kamada et al. discloses a solid, three-piece golf ball, having an ionomer cover and a core with inner and outer layers, where the inner layer has a diameter of 24 to 29 mm and a Shore D hardness of 15 to 30, and the outer layer has a diameter of 36 to 41 and a Shore D hardness of 55 to 65.

European Patent Application 0 633 043 discloses a solid, three-piece golf ball with an ionomer or balata cover, a center core, and an intermediate layer. The center core has a diameter of at least 29 mm and a specific gravity of less than 1.4. The intermediate layer has a thickness of at least 1 mm, a specific gravity of less than 1.2, and a hardness of at least 85 on the JIS-C scale.

Blending a polymer and an ionomer is one approach which has been used in forming golf ball covers, and thus golf balls, with improved properties. One such combination is disclosed in U.S. Pat. No. 4,858,924 to Saito, which teaches the use of a thermoplastic resin with a flexural modulus of 1,500 to 5,000 kg/cm$^2$ blended with an ionomer to form the cover of a golf ball. Particularly, polyamide elastomer, urethane elastomer, styrene-butadiene copolymer elastomer and polyester elastomer are said to be preferred when used alone or blended with a matrix resin, that is, another like flexible thermoplastic resin. The polyester elastomers are said to include block copoly(ether-esters), block copoly(lactone-esters) and aliphatic and aromatic dicarboxylic acid copolymerized polyesters. However, the Saito patent does not teach the use of the polyester, poly (trimethylene terephthalate), in a golf ball cover.

In pigmented golf ball covers, the color of the cover is enhanced by the use of optical brightener in combination with a pigment system. The use of an optical brightener is desired especially when the cover material is not white in appearance. By incorporating an optical brightener in the cover, the need for a supplemental paint coating can be reduced or eliminated. U.S. Pat. No. 4,679,795 to Melvin et al. discloses blends of optical brighteners with the following golf ball materials: polyolefins and their copolymers; polyurethanes; polyamides, polyamide blends with SURLYN®, polyethylene, ethylene copolymers and EPDM; vinyl and acrylic resins; thermoplastic rubbers such as urethanes, styrene block copolymers, copoly(ether-amides) and olefinic thermoplastic rubbers; and thermoplastic polyesters such as poly(ethylene terephthalate) (hereinafter "PET"), poly (butylene terephthalate) (hereinafter "PBT") and PETG. The reference contains no teaching, however, to use poly (trimethylene terephthalate) (hereinafter "PTT") in a pigmented golf ball cover with an optical brightener. In fact, none of the above disclosures describe the use of poly (trimethylene terephthalate) in golf balls.

Poly(trimethylene terephthalate) has been used mainly in carpet fiber and textile applications. However, similarities in tensile strength, flexural modulus, specific gravity, mold shrinkage, melting point, and glass transition temperature suggest that poly(trimethylene terephthalate) can be a good substitute for polyamides and polyamide blends used in golf ball covers, intermediate layers, and cores.

U.S. Pat. No. 5,981,654 is directed to compositions and methods for forming golf ball covers, cores and intermediate layers, wherein the composition comprises a blend of a polyamide and poly(trimethylene terephthalate) without optical brightener. The disclosure of that reference, however, contains no teaching or suggestion to formulate a composition without polyamide and with optical brightener.

As a result, a need exists for a golf ball incorporating poly(trimethylene terephthalate) and blends of poly (trimethylene terephthalate), having the feel and spin of balata covered balls and the durability and distance of ionomer covered balls. The present invention provides such a golf ball.

SUMMARY OF THE INVENTION

The present invention is directed to golf balls and in particular, to golf balls having at least one layer comprising poly(trimethylene terephthalate), either alone or in blends with other polymers wherein, when such other polymers are present, i.e., in the blend, they do not include a polyamide polymer.

While poly(trimethylene terephthalate) will generally be used in forming some or all of the cover layer(s) of the golf ball, it may also or alternatively comprise some or all of the core layer(s), and/or intermediate layer(s). The invention includes one-piece golf balls comprising poly(trimethylene terephthalate), either alone or as a blend, with other polymers, as well as two-piece and three-piece golf balls comprising at least one cover layer and a core.

In accordance with the invention, in a first embodiment, the golf ball has at least one layer, i.e., a core layer, an intermediate layer and/or a cover layer, comprised of a poly(trimethylene terephthalate) composition, wherein the poly(trimethylene terephthalate) composition is substantially free of polyamide polymer. As used herein, the term "poly(trimethylene terephthalate) composition" refers to both 100 wt % poly(trimethylene terephthalate) as well as a poly(trimethylene terephthalate) blend comprising from about 1 to about 99 wt % poly(trimethylene terephthalate) and from about 99 to about 1 weight percent of a non-polyamide second polymer component. Optionally, the second polymer component may be a polyurethane, an epoxy resin, a polystyrene, an acrylic, a polyethylene, a polyester, a polycarbonate or an acid copolymer or its ionomer derivative or blends thereof.

In another embodiment, the PTT-containing layer has a foamed structure. For a layer formed of a poly(trimethylene terephthalate) composition having a foamed structure, the preferred flexural modulus ranges from 1000 to 150,000 psi. For golf ball covers having a layer formed of a poly (trimethylene terephthalate) composition with a foamed structure, the layer preferably has a Shore D hardness of from about 15 to about 80 and a thickness of from about 0.005 to 0.125 inch. Generally, for golf balls having a layer formed of a poly(trimethylene terephthalate) composition with a foamed structure, the layer has a Shore D hardness of from about 15 to about 80 and a thickness of from about 0.005 to 0.125 inch. The core preferably has a diameter of from about 1 to 1.63 inch.

Where the layer comprising a poly(trimethylene terephthalate) composition is situated in an outer portion of the core, the core comprises a liquid center or a solid polymeric center. Optionally, the core further comprises an elastomer. Preferably the poly(trimethylene terephthalate) composition comprises an elastomer, such as polybutadiene, a metallic derivative of diacrylate, and from about 1 to about 75 parts by weight poly(trimethylene terephthalate). Preferably, the PTT is present in an amount of about 1 to about 50 parts by weight. More preferably, the PTT is present in an amount of about 5 to about 40 parts by weight. Most preferably, the PTT is present in an amount of about 5 to about 25 parts by weight.

In another embodiment, the invention is directed to a golf ball comprising a cover and a core, wherein the cover comprises a poly(trimethylene terephthalate) composition.

In a still further embodiment, the invention is directed to three-piece golf balls comprising at least one cover layer, at least one core layer and at least one intermediate layer between the cover and the core, where at least one layer comprises a poly(trimethylene terephthalate) composition. Optionally, the poly(trimethylene terephthalate) is blended with a non-polyamide second polymer component and the second polymer component may be a polyurethane, an epoxy resin, a polystyrene, an acrylic, a polyethylene, a polyester, a polycarbonate or an acid copolymer or its ionomer derivative or blends thereof; and the poly (trimethylene terephthalate) composition may be foamed or unfoamed. Preferably, the blend comprises about 10 to about 75 weight percent of poly(trimethylene terephthalate) and about 90 to about 25 weight percent of the second polymer component. More preferably, the blend comprises about 15 to about 40 weight percent of poly(trimethylene terephthalate) and about 85 to about 60 weight percent of the second polymer component.

Further, the core of the three-piece golf ball comprise a liquid or solid center. Optionally, the liquid or solid center may be wrapped in elastomeric windings, which may be comprised of a poly(trimethylene terephthalate) composition. As used herein, the liquid center comprises an outer envelope containing a liquid, wherein the envelope is formed of a poly(trimethylene terephthalate) composition.

In another embodiment, the invention provides a method of making a two-piece golf ball. The method comprises the steps of forming a golf ball core by conventional means and subsequently forming a cover around the core by either compression molding preformed half-shells of cover stock material comprising poly(trimethylene terephthalate) about the core or by injection molding cover stock material comprising a poly(trimethylene terephthalate) composition, wherein the poly(trimethylene terephthalate) composition may be foamed or unfoamed. Optionally, the poly (trimethylene terephthalate) may be blended with a polyurethane, epoxy resin, polyethylene, polyester, polystyrene, polycarbonate, acrylic or acid copolymer or its ionomer derivative or blends thereof. Golf balls that are manufactured in this manner will have mechanical properties superior to otherwise similar golf balls without poly (trimethylene terephthalate).

In an additional embodiment, this invention provides a method of making a multi-layer golf ball, which comprises forming a core layer, forming at least one intermediate layer about the core layer, and forming a cover layer over the at least one intermediate layer, wherein at least one of the layers comprises a poly(trimethylene terephthalate) composition and may be foamed or unfoamed. Optionally, the poly(trimethylene terephthalate) of the core layer, intermediate layer and/or cover layer may be blended with one or more conventional ionomeric and/or non-ionomeric thermoplastic polymers. Preferably, the non-ionomer thermoplastic elastomer polymer is selected from the group consisting of a block copolymer of copoly(ester—ester), a block copolymer of copoly(ester-ether), a block copolymer of copoly (urethane-ester), a block copolymer of copoly(urethane-ether), a block polystyrene thermoplastic elastomer comprising an unsaturated rubber, a block polystyrene thermoplastic elastomer comprising a functionalized substantially saturated rubber, a thermoplastic and elastomer blend comprising polypropylene and ethylene-propylene-diene monomer terpolymer or ethylene-propylene copolymer rubber, where the rubber is dynamically vulcanized, poly (ethylene terephthalate), poly(butylene terephthalate), poly (vinyl alcohol), poly(vinyl acetate), poly(silane), poly (vinylidene fluoride), acrylonitrile-butadiene-styrene copolymer, olefinic polymers, their copolymers, including functional comonomers, and mixtures thereof.

The use of a foamed poly(trimethylene terephthalate) composition also allows the golf ball designer to adjust the density or mass distribution of the ball to adjust the angular moment of inertia, and, thus, the spin rate and performance of the ball. Foamed materials also offer a potential cost savings due to the reduced use of polymeric material. Where at least a portion of the core is formed from a foamed poly(trimethylene terephthalate) composition, a density increasing filler material can be added to the cover or the intermediate layer to distribute the mass of the ball towards the outer surface and increase the angular moment of inertia. Similarly, where the layer forms at least a portion of the cover, the density increasing filler material can be added to the core to decrease the angular moment of inertia. Alternatively, where the layer forms at least a portion of the intermediate layer, a density increasing filler material can be added to either the cover or the core.

The novel golf ball of the invention offers improved mechanical properties in comparison to golf balls disclosed in the prior art, for instance, improved abrasion resistance, cut-resistance and durability. Further these balls also provide enhanced distance (i.e., resilience) without adversely affecting, and in many instances while improving, their "playability" characteristics, i.e., their impact resistance, spin, "click" and "feel", compression, etc.

DETAILED DESCRIPTION OF THE INVENTION

The invention is directed to methods and compositions for use in the manufacture of golf balls, particularly, golf ball cores, covers and/or intermediate layers. The golf balls of this invention have demonstrated improved durability, initial velocity and shear resistance.

As used herein, "pph" refers to parts per hundred parts by weight of a base material. The term "fillers" includes any compound or composition such as could be well known to one of ordinary skill in the art that may be used to vary the density and/or hardness properties of the golf ball.

As used herein, the term "layer" includes any generally spherical portion of a golf ball or golf ball core, center, or intermediate portion, including one-piece cores and one-piece balls. An "intermediate layer" is defined as a portion of the golf ball that occupies a portion of the volume between the cover and the core. Of course, as one of ordinary skill in the art would recognize, any of the core, cover, and intermediate layer(s) of the golf balls of the invention can be formed of one layer or a plurality of "layers", as that term is defined herein.

As used herein, the polymer blends, i.e., two or more polymers mixed with each other, of this invention can be prepared with blend components of varying molecular architecture. Examples of the parameters which may be varied include molecular weight, molecular weight distribution, tacticity and optionally, branching, degrees and arrangements of blockiness, block molecular weight and block molecular weight distribution, as is well known to those knowledgeable in the art of blending polymers.

As used herein, a "copolymer" is defined as a polymer comprising at least two different monomeric units. Thus, a polymeric chain made up of three different monomers (also known as a terpolymer) is included within the term "copolymer," as are polymer chains containing more than three different monomeric units. Copolymers may be formed in many ways known to those of ordinary skill in the art, for example, by polymerizing two or more different monomers, by graft copolymerization or block copolymerization, wherein an existing polymer chain is further reacted with a different monomer, and by a post-polymerization reaction, e.g., partial hydrolysis of the ester side-groups of a polymer.

As used herein, the term "dynamically vulcanized" is used when the elastomer of a thermoplastic and elastomer or of a rubber blend is intentionally crosslinked during the blending. As used herein, the term "non-polyamide polymer" is used to refer to a polymer without a plurality of amide units or moieties in the chain.

As used herein, the core assembly may be a liquid center, a solid center, or a liquid or solid center wrapped in elastomeric windings. As used herein, the term "liquid center" refers to an outer envelope surrounding or containing a liquid.

Broadly, the invention contemplates a golf ball having at least one layer comprising poly(trimethylene terephthalate). Optionally, the poly(trimethylene terephthalate may be blended with polyurethanes, epoxy resins, polystyrenes, acrylics, polyethylenes, polyesters, polycarbonates or acid copolymers or their ionomer derivatives or blends thereof.

Poly(trimethylene terephthalate) is an aromatic polyester which is a copolymer of trimethylene glycol and terephthalic acid. The synthesis of poly(trimethylene terephthalate) was first disclosed in U.S. Pat. No. 2,465,319 to Whinfield and Dickson. The poly(trimethylene terephthalate) useful in the invention can be synthesized by a variety of methods. For example, a synthetic route known to be used by Shell Chemical begins with the production of trimethylene glycol, a starting material for the synthesis of PTT. Trimethylene glycol is produced from the hydroformation of ethylene oxide, as shown below:

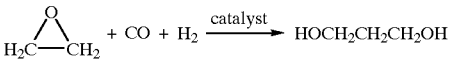

The trimethylene glycol is then polymerized in a condensation reaction with terephthalic acid to give PTT. The structure of PTT is shown below:

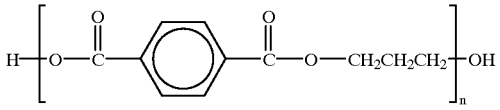

As one skilled in the art of polymer synthesis knows, however, many different synthetic protocols can be used to prepare a given compound. Different routes can involve more or less expensive reagents, easier or more difficult separation or purification procedures, straightforward or cumbersome scale-up, and higher or lower yield. The skilled synthetic organic polymer chemist knows well how to balance the competing characteristics of synthetic strategies. Thus the compounds of the invention are not limited by the choice of synthetic strategy, and any synthetic strategy that yields PTT can be used. However, since PTT is commercially available, for instance from Shell under the trademark CORTERRA®, it is not necessary to synthesize the material.

Tests on PTT fibers for use in carpet fiber applications have shown that PTT has unexpectedly superior properties when compared with poly(ethylene terephthalate) and poly (butylene terephthalate). Without being bound by theory, it is believed that these unexpected properties are examples of the "odd carbon" effect, whereby polymers containing the three-carbon PTT exhibit unexpected properties in comparison to polymers with two carbon PET and/or the four carbon PBT.

Moreover, similarities in tensile strength, flexural modulus, specific gravity, mold shrinkage, melting point, and glass transition temperature suggest that poly (trimethylene terephthalate) is a good substitute for polyamides and polyamide blends used in golf ball covers, intermediate layers, and cores. Poly(trimethylene terephthalate) is also an excellent replacement for nylon 6 and nylon 6/6, which are also used in forming golf balls.

As noted above, U.S. Pat. No. 5,981,654 is directed to compositions and methods for forming golf ball covers, cores and intermediate layers, wherein the composition comprises a blend of a polyamide and poly(trimethylene terephthalate) and is substantially free of optical brightener.

However, this disclosure contains no teaching or suggestion to formulate a non-polyamide blend with PTT and optical brightener.

The present invention, on the other hand, contains no limitation as to the content of optical brightener. In fact, optical brightener may be used with PTT. However, it is not necessary that an optical brightener be used with PTT since PTT is already white in appearance. As noted by Traub et al. in *Die Angewandte Makromolekulare Chemie* 230 (1995) 180, when PTT is synthesized with titanium catalyst, there is little (if any) discoloration.

In accordance with the invention, poly(trimethylene terephthalate) comprises from about 1 to about 100 percent by weight of the golf ball cover composition and/or the intermediate layer composition. Unless otherwise stated herein, all percentages are given in percent by weight of the total composition.

Optionally, the golf ball cover and/or intermediate layer comprises PTT and a second polymer component, wherein the PTT comprises from about 10 to about 90%, more preferably from about 10 to about 75% and most preferably from about 15 to about 40%; wherein the second polymer component comprises about 90 to 10%, more preferably from about 90 to about 25% and most preferably from about 85 to about 60%; and wherein the second polymer component is comprised of one or more polymers such as, but not limited to conventionally produced ionomers, polyurethanes, epoxy resins, polystyrenes, acrylics, polyethylenes, polycarbonates and polyesters.

The polymer compositions may be foamed during molding by any conventional foaming or blowing agent. In addition, foamed poly(trimethylene terephthalate) compositions may be thermoformed, and, thus can be compression molded. Therefore, either injection molding or compression molding may be used to form a layer of foamed poly (trimethylene terephthalate) polymer in the cover layer, core layer, or intermediate layer of a golf ball according to the invention. Poly(trimethylene terephthalate) polymers and poly(trimethylene terephthalate) polymer blends are resilient, easily processed materials that are less expensive than ionomers, and allow highly durable golf balls to be produced with virtually any combination of feel and spin rate.

Conventional ionomers useful in this invention may include SURLYN®, ESCOR®, IOTEK®, and IMAC® copolymers. Such ionomers are obtained by providing thermolabile ionic crosslinking to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in 5–35 (preferably 10–35, more preferably at least about 16–35, most preferably at least about 16–20) weight percent of the polymer, wherein the acid moiety is neutralized 1–90% (preferably at least 40%, most preferably at least about 60%) to form an ionomer by a cation such as lithium, sodium, potassium, magnesium, calcium, barium, lead, tin, zinc or aluminum, or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art as described in, e.g., U.S. Pat. No. 3,262,272.

As mentioned above, other suitable materials for forming the cover and/or intermediate layers, i.e., for use in combination with PTT, include ionomers, polyurethanes, epoxy resins, polystyrenes, acrylics, polyethylenes, polycarbonates and polyesters. For example, the cover and/or intermediate layer may be formed from a blend of PTT and conventionally produced thermoplastic or thermoset urethanes/polyurethanes, urethane ionomers and urethane epoxies and blends thereof.

Among the suitable thermoplastic polyurethanes are block copolymers of copolyurethanes which typically contain blocks of a polyurethane oligomer (material with the higher softening point) alternating with lower softening point blocks of either a polyether oligomer, for a block copoly(ether-urethane), a polyester oligomer for a block copoly(ester-urethane) or a polybutadiene or hydrogenated polybutadiene oligomer for a block copoly(butadiene-urethane). The polyether oligomer is typically a polyether macroglycol, such as polytetramethylene ether glycol. The polybutadiene oligomer is a dihydroxy terminated polybutadiene oligomer, which may optionally be partially or fully hydrogenated. The polyurethane block typically consists of 4,4'-diphenylmethane diisocyanate, toluene diisocyanate (any combination of the 2,4- and 2,6-isomers) or para-phenylene diisocyanate, all chain extended with an aliphatic diol, typically 1,4-butanediol. Examples of suitable commercially available thermoplastic polyurethanes include the ESTANE® series from the B. F. Goodrich Company, which includes ESTANE® 58133, 58134, 58144 and 58311; the PELLETHANE® series from Dow Chemical, which includes PELLETHANE® 2102-90A and 2103-70A; ELASTOLLAN® from BASF; DESMOPAN® and TEXIN® from Bayer; and Q-THANE® from Morton International.

As noted above, PTT can also be blended with an epoxy resin. A generic representation of the structure of suitable epoxy resins is described below:

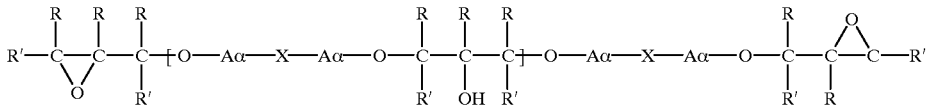

Wherein:

R, R′ = H or $C_nH_{2n+1}$ where n = 1–6

Aα = cyclic or aromatic and may contain substituted derivatives such as acids and salts

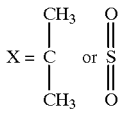

Examples of suitable commercially available epoxy resins include but are not limited to "Epon" resins available from Shell and "Novalac" resins from Dow.

Suitable polyethylenes for blending with PTT to form the cover and/or intermediate layer include homo and copolymers of ethylene containing functional groups such as maleic anhydride, carboxylic acid and hydroxyl groups. For example, these functional groups are introduced either by chemical grafting as in the case of grafting maleic anhydride such as that sold commercially under the tradename "FUSABOND" by DuPont (Canada), or by copolymerizing the ethylene monomer with an unsaturated carboxylic acid comonomer such as a methacrylic acid sold commercially under the tradename "NUCREL" by DuPont.

A generic representation of the structure of suitable polyesters for blending with PTT to form the cover and/or intermediate layer is set forth below:

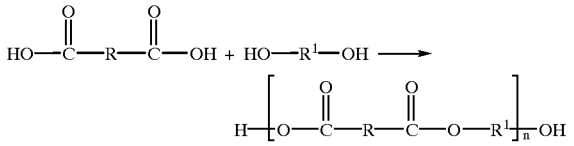

Wherein:

R=substitued and unsubstituted aliphatic, cyclic or aromatic;

$R^1$=aliphatic or aromatic (e.g. bisphenol-A or bisphenol-S); and n>50

Catalysts such as manganese acetate, antimony oxide and titanium alkoxides are commonly used producing polyester polymers. Examples of suitable commercially available polyesters include materials sold under the tradenames "EASTPAK" PET polyester and "EASTAR" PETG from Eastman Chemicals, "DACRON" and "TERGLENE" from DuPont.

Examples of other specific polymers or families of polymers which may be used in conjunction with PTT in golf ball cover and/or intermediate layer compositions include: poly(ethylethylene), poly(heptylethylene), poly(hexyldecylethylene), poly(isopentylethylene), poly(1,1-dimethyltrimethylene), poly(1,1,2-trimethyltrimethylene), aliphatic polyketones (such as ethylene-carbon monoxide-propylene sold commercially under the tradename "CARILON" by Shell), poly(butyl acrylate), poly(4-cyanobutyl acrylate), poly(2-ethylbutyl acrylate), poly(heptyl acrylate), poly(2-methylbutyl acrylate), poly(3-methylbutyl acrylate), poly(octadecyl methacrylate), poly(butoxyethylene), poly(methoxyethylene), poly(pentyloxyethylene), poly(1,1-dichloroethylene), poly(cyclopentylacetoxyethylene), poly(4-dodecylstyrene), poly(4-tetradecylstyrene), poly(oxyethylethylene), poly(oxytetramethylene), poly(oxytrimethylene), poly(oxycarbonylpentamethylene), poly(oxycarbonyl-3-methylpentamethylene), poly(oxycarbonyl-1,5-dimethylpentamethylene), poly(silanes), poly(silazanes), poly(furan tetracarboxylic acid diimides), and poly(vinylidene fluoride), as well as the classes of polymers to which they belong.

The invention is further directed to a golf ball cover and/or intermediate layer composition comprising a blend of PTT and non-ionomeric thermoplastic polymer. For example, such non-ionomeric thermoplastic polymers may include: block copolymer of poly(ether-ester) copolymers, such as HYTREL® available from DuPont, partially or fully hydrogenated styrene-butadiene-styrene block copolymers, such as the KRATON D® grades available from Shell Chemical, styrene-(ethylene-propylene)-styrene or styrene-(ethylene-butylene)-styrene block copolymers, such as the KRATON G® series from Shell Chemical, Septon HG-252 from Kurary, either of the KRATON®-type copolymers with maleic anhydride or sulfonic graft or hydroxyl functionality, such as the KRATON FD® or KRATON FG® series available from Shell Chemical, olefinic copolymers, such as the ethylene-methyl acrylate or ethylene-butyl acrylate series available from Quantum Chemical, ethylene-octene copolymers made with metallocene catalysts, such as the AFFINITY® or ENGAGE® series available from Dow, ethylene-alpha olefin copolymers and terpolymers made from metallocene catalysts, such as the EXACT® series available from Exxon, block copolymer of poly(urethane-ester) or block copolymer of poly(urethane-ether) or block copolymer of poly(urethane-caprolactone), polyethylene glycol, such as CARBOWAX® available from Union Carbide, polycaprolactone, polycaprolactam, polyesters, such as EKTAR® available from Eastman, ethylene-propylene-(diene monomer) terpolymers and their sulfonated or carboxylated derivatives, and SANTOPRENE® from Monsanto.

The polymer blends of this invention can be prepared with or without the addition of a compatibilizer and with varying molecular architecture of blend components, such as varying molecular weight, tacticity, degrees of blockiness, etc., as is well known to those knowledgeable in the art of blending polymers.

Blending of the polymers is accomplished in a conventional manner using conventional equipment. Good results have been obtained by mixing the polymers or resins in a solid, pelletized form and then placing the mix into a hopper which is used to feed the heated barrel of an injection molding machine. Further mixing is accomplished by a screw in the heated barrel. The injection molding machine is used either to make preformed half-shells for compression molding about a core or for molding flowable cover stock about a core using a retractable-pin mold. Such machines are conventional.

Additionally, conventional components, known to those skilled in the art, which can be added to the cover compositions of the invention include white pigments, optical brighteners, processing aids and U.V. stabilizers such as TINUVIN™ 213 and TINUVIN™ 328. Also, light stabilizers such as, for example, TINUVIN™ 770 and TINUVIN™ 765, may also be used. TINUVIN™ products are available from Ciba-Geigy. Dyes, as well as fluorescent pigments may also be used in the golf ball covers produced with polymers formed according to the invention. Such additional ingredients may be used in any amounts that will achieve their desired purpose. However conventional amounts range of from about 0.05% to about 1.5%, or more preferably, from about 0.5% to about 1.0%.

Other conventional ingredients, e.g., fillers are well known to the person of ordinary skill in the art and may be included in cover and intermediate layer blends of the invention in amounts effective to achieve their known purpose.

An optional filler component may be chosen to impart additional density to blends of the previously described components. The selection of such filler(s) is dependent upon the type of golf ball desired (i.e., one-piece, two-piece multilayer or wound), as will be more fully detailed below. Generally, the filler will be inorganic, having a density greater than about 2 g/cc, preferably greater than 4 g/cc, and will be present in amounts between 5 and 65 weight percent based on the total weight of the polymer components. Examples of useful fillers include metals, such as tungsten and titanium; metal alloys, such as brass and bronze; metal oxides, such as zinc oxide and calcium oxide; metal salts, such as barium sulfate, lead silicate and tungsten carbide; and other well known corresponding salts and oxides thereof.

PTT may be added to conventional core compositions to form cores for two-piece balls or centers of wound balls. Conventional core compositions comprise polybutadiene as the elastomer and, in parts by weight based on 100 parts polybutadiene (pph), 20–50 pph of a metal salt acrylate derivative such as zinc diacrylate, zinc dimethacrylate, or zinc monomethacrylate, preferably zinc diacrylate and up to about 75 pph of PTT. Preferably, the PTT is present in an amount of about 1 to about 50 pph. More preferably, the PTT is present in an amount of about 5 to about 40 pph. Most preferably, the PTT is present in an amount of about 5 to about 25 pph. The core compositions of this invention may be foamed or unfoamed.

The compositions of the invention may also include fillers, added to the elastomeric composition to adjust the density and/or specific gravity of the core. Fillers useful in the golf ball core according to the invention include, for example, zinc oxide, calcium oxide, barium sulfate, and regrind (which is recycled core molding matrix ground to 20 mesh particle size). The amount and type of filler utilized is governed by the amount and weight of other ingredients in the composition, since a maximum golf ball weight of 1.620 ounces (45.92 gm) has been established by the USGA. Appropriate fillers, including reactive fillers, known by those skilled in the art, generally have a specific gravity in the range of from about 2.0 to 5.6.

Antioxidants may also be included in the elastomer cores produced according to the invention. Antioxidants are compounds which prevent the breakdown of the elastomer. Antioxidants useful in the invention include, but are not limited to, quinoline type antioxidants, amine type antioxidants, and phenolic type antioxidants.

Other ingredients such as accelerators, e.g. tetra methylthiuram, processing aids, processing oils, plasticizers, dyes and pigments, as well as other additives well known to the skilled artisan may also be used in the invention in amounts sufficient to achieve the purpose for which they are typically used.

The core compositions of the invention may be produced by forming a mixture comprising, for example, polybutadiene, zinc diacrylate, and PTT. In preparing the core compositions, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide (s) free radical initiator(s) are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. These cores can then be used to make finished golf balls by surrounding the cores with an intermediate layer and/or cover materials.

Layers formed of a poly(trimethylene terephthalate) composition may be produced in golf balls in accordance with the invention by injection molding or compression molding a layer of a poly(trimethylene terephthalate) composition about a previously formed center or core, cover, or intermediate layer. Cores comprising a poly(trimethylene terephthalate) composition may also be formed directly by injection molding or compression molding. When the layer or core is injection molded, a physical or chemical blowing or foaming agent may be included to produce a foamed layer. Blowing or foaming agents useful in forming foamed poly(trimethylene terephthalate) compositions include, but are not limited to organic blowing agents, such as azobisformamide; azobisisobutyronitrile; diazoaminobenzene; N,N-dimethyl-N,N-dinitroso terephthalamide; N,N-dinitrosopentamethylene-tetramine; benzenesulfonylhydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenyl-methyl-uranthan; p-sulfonhydrazide; peroxides; and inorganic blowing agents such as ammonium bicarbonate and sodium bicarbonate. A gas, such as air, nitrogen, carbon dioxide, etc., can also be injected into the blend during the injection molding process.

In a further embodiment, foamed poly(trimethylene terephthalate) compositions may be formed by blending microspheres with the poly(trimethylene terephthalate) composition either during or before the molding process. Polymeric, ceramic, metal, and glass microspheres are useful in the invention, and may be solid or hollow and filled or unfilled. Microspheres up to about 1000 micrometers in diameter are useful in the poly(trimethylene terephthalate) compositions of the invention.

The invention is further directed to a method of making a golf ball. The method comprises, in one embodiment, the steps of forming a golf ball core by conventional means and subsequently forming a cover around the core by either compression molding preformed half-shells of cover stock material comprising a poly(trimethylene terephthalate) composition about the core or by injection molding cover stock material comprising the poly(trimethylene terephthalate) composition about the core. Optionally, the poly (trimethylene terephthalate) is blended with a non-polyamide second polymer component and the non-polyamide second component is a polyurethane, epoxy resin, polystyrene, acrylic, polyethylene, polyester, polycarbonate or acid copolymer or its ionomer derivative or blends thereof. In addition, the polymer compositions in this invention may be foamed or unfoamed.

The invention further provides a method of making a golf ball, which comprises forming a core layer, forming at least one intermediate layer about the core layer, and forming a cover layer over the at least one intermediate layer, where at least one of the layers comprises a poly(trimethylene terephthalate) composition, wherein the PTT is either alone or blended with other polymers. Optionally, the poly (trimethylene terephthalate) of the core, intermediate and/or cover layer may be blended with one or more conventional ionomeric and/or non-ionomeric thermoplastic polymers. In addition, the polymer compositions in this invention may be foamed or unfoamed. Preferably, the non-ionomer thermoplastic elastomer polymer is selected from the group consisting of a block copolymer of copoly(ester—ester), a block copolymer of copoly(ester-ether), a block copolymer of copoly(urethane-ester), a block copolymer of copoly (urethane-ether), a block polystyrene thermoplastic elastomer comprising an unsaturated rubber, a block polystyrene thermoplastic elastomer comprising a functionalized substantially saturated rubber, a thermoplastic and elastomer blend comprising polypropylene and ethylene-propylene-diene monomer terpolymer or ethylene-propylene copolymer rubber where the rubber is dynamically vulcanized, poly(ethylene terephthalate), poly(butylene terephthalate), poly(vinyl alcohol), poly(vinyl acetate), poly(silane), poly (vinylidene fluoride), acrylonitrile-butadiene-styrene copolymer, olefinic polymers, their copolymers, including functional comonomers, and mixtures thereof.

One-piece golf balls comprising PTT, either alone or as a blend with other polymers, two-piece golf balls comprising a cover surrounding a core and wound golf balls, in which a liquid, semi-solid, or solid core is surrounded by an elastic synthetic material are all within the scope of the invention. Any type of golf ball core can be used in the golf balls of the invention. However, preferred cores include some amount of cis-polybutadiene.

Typically, the covers are formed around the solid or wound cores by either compression molding preformed half-shells of the cover stock material or by injection molding the cover stock about the core. Half-shells are made by injection molding a cover stock into a conventional half-shell mold in a conventional manner. The preferred method is compression molding of preformed half-shells.

In compression molding, the half-shells of the stock material are formed by injection molding the cover stock material at 300° F.-520° F. into a conventional half-shell mold for a short time. The preformed half-shells are then placed about a core and the assembly is introduced into a compression molding machine. The compression molding machine is a hydraulic press having an upper and lower mold plate. As taught by U.S. Pat. No. 4,508,309 to Brown, such mold plates have half molds, each of which is registered with another half mold in the opposite mold plate. It has been found that a golf ball is formed with a cover in accordance with the invention when the half-shells are compression molded about a core. The molded balls are then cooled while still in the mold and finally removed when the cover is hard enough to be handled without deforming.

Alternatively, golf balls can be covered solely with the use of an injection molding technique utilizing an injection molding machine in which the core assembly is placed in a mold cavity. The core assembly is held in place through the use of several retractable pins in a known manner. Such injection molding machines are well known in the art. The molten cover material is injected into the cavity surrounding the core. As the cover material cools and hardens, the pins retract and the molded ball is ejected from the mold. The balls then undergo conventional finishing operations such as buffing, painting and stamping.

The invention can be used in forming golf balls of any desired size. "The Rules of Golf" by the USGA dictate that the size of a competition golf ball must be more than 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred, however diameters anywhere in the range of from 1.70 to about 1.95 inches can be used. Oversize golf balls with diameters above about 1.760 inches to as big as 2.75 inches are also within the scope of the invention.

All patents cited in the foregoing text are expressly incorporated herein by reference in their entirety. It will be understood that the claims are intended to cover all changes and modifications of the preferred embodiments of the invention, herein chosen for the purpose of illustration, which do not constitute a departure from the spirit and scope of the invention.

What is claimed is:

1. A golf ball comprising a cover layer, a core layer and an intermediate layer between the cover layer and the core layer, wherein the intermediate layer comprises poly (trimethylene terephthalate) and is substantially free of polyamide polymer.

2. The golf ball of claim 1, wherein the cover layer comprises a polymer selected from the group consisting of ionomers, polyurethanes, epoxy resins, polystyrenes, acrylics, polyethylenes, polycarbonate and polyesters.

3. The golf ball of claim 1, wherein the core layer comprises a center and an outer cover layer.

4. The golf ball of claim 1, wherein the cover, intermediate or core layer has a foamed structure.

5. The golf ball of claim 1, wherein the cover, intermediate or core layer comprises a density increasing filler.

6. The golf ball of claim 5, wherein the density increasing filler is selected from the group consisting of metals, metal alloys, metal oxides and metal salts.

7. A golf ball comprising a cover layer, a core layer and an intermediate layer between the cover layer and the core layer, wherein the intermediate layer comprises from about 1 to about 99 weight percent of poly(trimethylene terephthalate) and from about 99 to about 1 weight percent of a non-polyamide second polymer component.

8. The golf ball of claim 7, wherein the intermediate layer has a thickness of from about 0.005 to about 0.125 inches.

9. The golf ball of claim 7, wherein the intermediate layer has a Shore D hardness of from about 15 to about 80.

10. The golf ball of claim 7, wherein the core layer has a diameter of from about 1 to about 1.63 inches.

11. The golf ball of claim 7, wherein the cover layer is polyurethane.

12. The golf ball of claim 11, wherein the cover layer is thermoset polyurethane.

13. The golf ball of claim 11, wherein the cover layer is thermoplastic polyurethane.

14. The golf ball of claim 7, wherein the intermediate layer further comprises filler.

15. The golf ball of claim 7, wherein the non-polyamide second polymer component is a non-ionomeric thermoplastic polymer or ionomeric thermoplastic polymer.

16. The golf ball of claim 15, wherein the non-ionomeric thermoplastic polymer is selected from a group consisting of block copolymer of poly(ether-ester), partially or fully hydrogenated styrene-butadiene-styrene block copolymers, styrene-(ethylene-propylene)-styrene block copolymers and their maleic anhydride or sulfonic graft or hydroxyl functional polymers, styrene-ethylene-butylene-styrene block copolymers and their maleic anhydride or sulfonic graft or hydroxyl functional polymers, olefinic polymers, metallocene catalyzed homo- and copolymers, block copolymer of poly(urethane-ether), block copolymer of poly(urethane-caprolactone), ethylene-propylene-diene terpolymers and their sulfonated or carboxylated derivatives and aliphatic ones.

17. The golf ball of claim 16, wherein the olefinic polymer is ethylene-methyl acrylate or ethylene-butyl acrylate.

18. The golf ball of claim 15, where the ionomeric thermoplastic polymer is selected from a group consisting of an acid containing ethylene copolymer moiety having E/X/Y copolymers where E is ethylene, X is a softening comonomer present in 0–50 wt % of the polymer and Y is acrylic or methacrylic acid present in 5–35 wt % of the polymer, wherein the acid moiety is neutralized from 1 to 90% by metal ions and wherein the metal ion is lithium, sodium, potassium, magnesium, calcium, barium, lead, tin, zinc, aluminum or a mixture thereof.

19. The golf ball of claim 18, wherein the softening comonomer is acrylate or methacrylate.

20. The golf ball of claim 18, wherein the ionomeric thermoplastic polymer is selected from the group consisting of ethylene/methacrylic acid, ethylene/methacrylic acid/n-butyl acrylate, ethylene/methacrylic acid/iso-butyl acrylate, ethylene/methacrylic acid/n-butyl methacrylate and ethylene/methacrylic acid/methyl methacrylate.

* * * * *